US010466000B2

(12) United States Patent
Gardner

(10) Patent No.: US 10,466,000 B2
(45) Date of Patent: Nov. 5, 2019

(54) GAS FLOW VOLUME CONTROL APPARATUS FOR FIREARMS

(71) Applicant: Todd Conrad Gardner, Orlando, FL (US)

(72) Inventor: Todd Conrad Gardner, Orlando, FL (US)

( * ) Notice: Subject to any disclaimer, the term of this patent is extended or adjusted under 35 U.S.C. 154(b) by 0 days.

(21) Appl. No.: 16/057,583

(22) Filed: Aug. 7, 2018

(65) Prior Publication Data

US 2019/0041147 A1 Feb. 7, 2019

Related U.S. Application Data

(60) Provisional application No. 62/542,017, filed on Aug. 7, 2017.

(51) Int. Cl.
*F41A 5/28* (2006.01)

(52) U.S. Cl.
CPC ..... *F41A 5/28* (2013.01)

(58) Field of Classification Search
CPC ..... F41A 5/28; F41A 5/26; F41A 5/18; F41A 5/20; F41A 21/28; F41A 3/62; F41A 21/00; F41C 23/16
USPC ..... 89/193, 129.01, 191.02, 192; 124/56
See application file for complete search history.

(56) References Cited

U.S. PATENT DOCUMENTS 1,431,059 A * 10/1922 Sutter ..... F41A 3/40 138/46
2,341,680 A * 2/1944 Williams ..... F41A 5/26 89/193
2,783,685 A * 3/1957 Green ..... F41A 5/28 297/248
2,918,848 A * 12/1959 Maillard ..... F41A 5/28 89/193
3,527,194 A * 9/1970 Desrochers ..... F41B 11/62 124/37
5,831,202 A * 11/1998 Rustick ..... F41A 21/26 89/193
5,945,626 A * 8/1999 Robbins ..... F41A 5/26 42/111
7,469,624 B1 * 12/2008 Adams ..... F41A 5/26 89/191.01
8,161,864 B1 * 4/2012 Vuksanovich ..... F41A 5/26 89/191.01
8,596,185 B1 * 12/2013 Soong ..... F41A 5/28 89/193

(Continued)

*Primary Examiner* — Joshua E Freeman
*Assistant Examiner* — Bridget A Cochran

(57) ABSTRACT

A gas flow volume control apparatus for firearm that includes an adjustable gas block, an adjustment member, and a securing member. The adjustable gas block efficiently redirects a flow of high-pressure gas from inside the gun barrel of the firearm into the gas tube of the firearm drive the gas-operated reloading mechanism of the firearm. The adjustable gas block that includes a gas-flow channel, a gas-tube channel, a flow-adjustment channel is adjacently connected to the securing member. The gas-flow channel collects high-pressure gas from the gun barrel and discharges into the gas-tube channel through the flow-adjustment channel as all three channels are in fluid communication with each other within the adjustable gas block. The adjustment member allows a user selectively controls the amount of high-pressure gas that is collected within the flow-adjustment channel.

20 Claims, 8 Drawing Sheets

(56) References Cited

U.S. PATENT DOCUMENTS 8,887,616 B2 * 11/2014 Kenney ..... F41A 5/28 89/193
8,960,069 B1 * 2/2015 Soong ..... F41A 5/28 89/193
D742,990 S * 11/2015 Huang ..... D22/108
9,243,859 B1 * 1/2016 Miller ..... F41A 5/26
9,273,916 B1 * 3/2016 Russo ..... F41A 5/26
9,335,106 B1 * 5/2016 Simon ..... F41A 5/28
9,372,039 B1 * 6/2016 Russo ..... F41A 5/28
9,410,756 B2 8/2016 Gardner
D767,707 S * 9/2016 Huang ..... D22/108
9,523,543 B1 * 12/2016 Brown ..... F41A 5/26
9,671,184 B1 * 6/2017 Russo ..... F41A 5/28
10,151,545 B1 * 12/2018 Hill ..... F41A 5/28
2006/0065112 A1 * 3/2006 Kuczynko ..... F41A 5/28 89/193
2006/0283318 A1 * 12/2006 Beaty ..... F41A 5/26 89/193
2008/0307954 A1 * 12/2008 Fluhr ..... F41A 5/28 89/193
2009/0229454 A1 * 9/2009 Fluhr ..... F41A 5/26 89/193
2010/0186582 A1 * 7/2010 Juarez ..... F41A 5/28 89/191.01
2010/0218671 A1 * 9/2010 Mayberry ..... F41A 5/28 89/192
2010/0269682 A1 * 10/2010 Vuksanovich ..... F41A 3/26 89/191.01
2010/0275769 A1 * 11/2010 Brittingham ..... F41A 5/18 89/193
2010/0275770 A1 * 11/2010 Noveske ..... F41A 5/28 89/193
2010/0282066 A1 * 11/2010 Tankersley ..... F41A 5/26 89/193
2011/0023699 A1 * 2/2011 Barrett ..... F41A 5/28 89/193
2011/0179945 A1 * 7/2011 Clark ..... F41A 5/18 89/193
2011/0271827 A1 * 11/2011 Larson ..... F41A 5/28 89/193
2012/0137872 A1 * 6/2012 Crommett ..... F41A 5/28 89/193
2012/0152106 A1 * 6/2012 Langevin ..... F41A 5/24 89/193
2012/0167756 A1 * 7/2012 Larue ..... F41A 5/28 89/193
2012/0167757 A1 * 7/2012 Gomez ..... F41G 1/02 89/193
2012/0180648 A1 * 7/2012 Sullivan ..... F16J 9/16 89/193
2013/0025445 A1 * 1/2013 Windauer ..... F41A 5/26 89/193
2013/0055883 A1 * 3/2013 Cassels ..... F41A 5/28 89/193
2013/0098235 A1 * 4/2013 Reinken ..... F41A 5/28 89/193
2013/0269510 A1 * 10/2013 Sullivan ..... F41A 5/28 89/193
2013/0284008 A1 * 10/2013 Pizano ..... F41A 5/26 89/193
2014/0000446 A1 * 1/2014 Hall ..... F41A 5/28 89/129.01
2014/0060312 A1 * 3/2014 Ruck ..... F41A 5/28 89/193
2014/0076143 A1 * 3/2014 Hall ..... F41A 19/03 89/129.01
2014/0076149 A1 * 3/2014 Adams ..... F41A 5/28 89/192
2014/0076150 A1 * 3/2014 Brinkmeyer ..... F41A 5/28 89/193
2014/0083286 A1 * 3/2014 Gomez ..... F41A 5/28 89/193
2014/0190344 A1 * 7/2014 Kenney ..... F41A 5/28 89/193
2014/0224114 A1 * 8/2014 Faxon ..... F41A 15/14 89/193
2015/0176933 A1 * 6/2015 Adams ..... F41A 5/28 89/191.02
2015/0253091 A1 * 9/2015 Gardner ..... F41A 5/20 89/193
2016/0003566 A1 * 1/2016 Gomirato ..... F41A 5/28 89/193
2016/0161200 A1 * 6/2016 Windauer ..... F41A 5/28 89/193
2016/0178299 A1 * 6/2016 Cassels ..... F41A 5/28 89/193
2016/0202012 A1 * 7/2016 Kokinis ..... F41A 5/26 89/193
2016/0209138 A1 * 7/2016 DeSomma ..... F41A 5/28
2016/0265860 A1 * 9/2016 Schilling ..... F41A 5/28
2017/0234634 A1 * 8/2017 Hirt ..... F41A 5/18 89/193
2017/0307315 A1 * 10/2017 McGloin ..... F41A 5/28
2018/0172376 A1 * 6/2018 Alexander ..... F41A 9/72
2018/0180370 A1 * 6/2018 Zheng ..... F41A 5/28

* cited by examiner

GAS FLOW VOLUME CONTROL APPARATUS FOR FIREARMS

The current application claims a priority to the U.S. Provisional Patent application Ser. No. 62/542,017 filed on Aug. 7, 2017.

FIELD OF THE INVENTION

The present invention relates generally to attachments for firearms which are meant to alter or redirect the produced gas flow when the firearm is discharged. More specifically, the present invention is a gas flow volume control apparatus for firearms that allows for variable harvesting of the excess gasses produced by a bullet discharge. Harvested gas flow from a bullet discharge is utilized to chamber a new round and rearm the firing mechanism of the firearm thus readying the firearm to discharge again.

BACKGROUND OF THE INVENTION

Firearms are commonly used tools around the world. Firearms utilize various technologies and mechanism to efficiently operate and provide a more comfortable and efficient experience to the user. One type of firearms, gas-operated firearms, utilize a portion of the high-pressure gas generated by the cartridge being fired to power a mechanism to extract the spent case and insert a new cartridge into the chamber. It is traditional for gas-operated firearms to have a port or orifice at a distance on top of the barrel of the firearm. This port allows some of the high-pressure gas generated inside the chamber to flow into a gas block. The gas block is a device attached on top of the port on the chamber to receive a portion of the high-pressure gas from inside the chamber and redirect it to a gas tube which drives the bolt carrier and cycles the action, meaning the disposal of the spent case and the loading of a new cartridge. Many of the existing gas blocks traditionally comprise two or more chambers which direct the flow of the high-pressure gas into the gas tube. Most of these gas blocks align the various chambers vertically or horizontally, which results in the high-pressure gas to forcefully flow through the gas block and into the gas tube. Some of the existing gas blocks further allow the user to adjust how much high-pressure gas is directed into the gas tube. However, many of the existing gas blocks that allow users to adjust how much gas flows through the gas block are not low profile and do not efficiently reduce or increase the flow of the high-pressure gas. This is mostly due to the number of components and their complicated configuration of the adjustable gas blocks. Thus, an effective and adjustable low-profile gas block which directs the flow of the high-pressure gas through offset chambers is beneficial and necessary.

An objective of the present invention is to provide a gas block which comprises one or more offset chambers. Off-setting one or more of the internal chambers of the gas block alleviates the force generated by the flow of the high-pressure gas through the gas block. Another objective of the present invention is to provide a gas block which is low profile and adjustable. A low-profile gas block is oftentimes desired for many operations where a normal gas block would obstruct the use of other accessories or attachments for the firearm. Another objective of the present invention is to provide a gas block which can be easily mounted on a firearm. While many gas blocks offer a method to mount the gas block to the barrel of the firearm, most of the methods or mechanisms are too complicated. Thus, a gas block which is easy to mount on the barrel of the firearm is beneficial and necessary. Furthermore, an adjustable low-profile gas block provides greater functionality a normal gas block would not be able to provide. Additional advantages of the present invention are set forth in part in the description which follows, and in part is be obvious from the description, or may be learned by practice of the present invention. Additional advantages of the present invention may be realized and attained by means of the instrumentalities and combinations particularly pointed out in the detailed description of the present invention section. Further benefits and advantages of the embodiments of the present invention are become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention.

Figure 1:
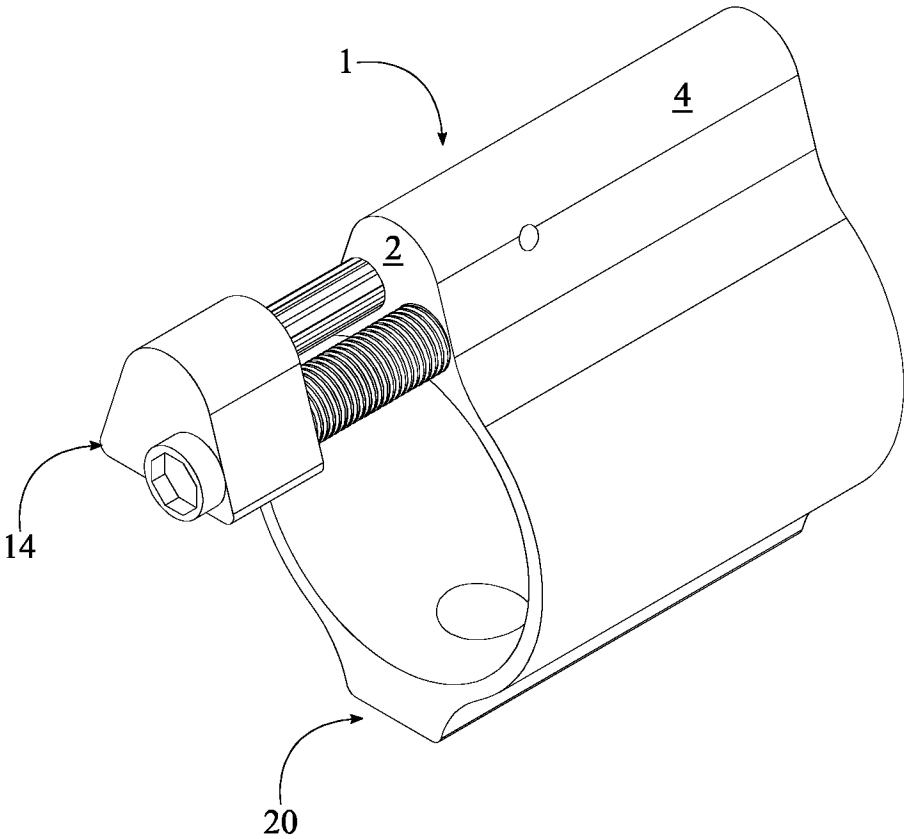
FIG. 1 is a front perspective view of the present invention.
Figure 2:
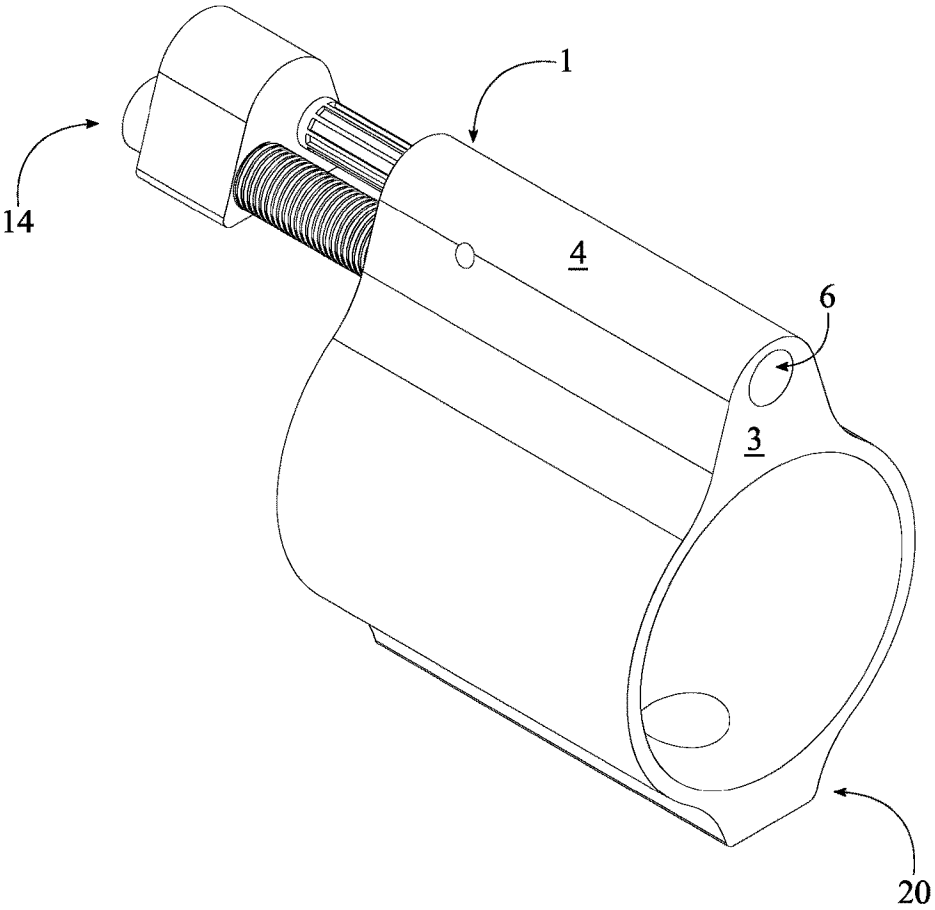
FIG. 2 is a rear perspective view of the present invention.
Figure 3:
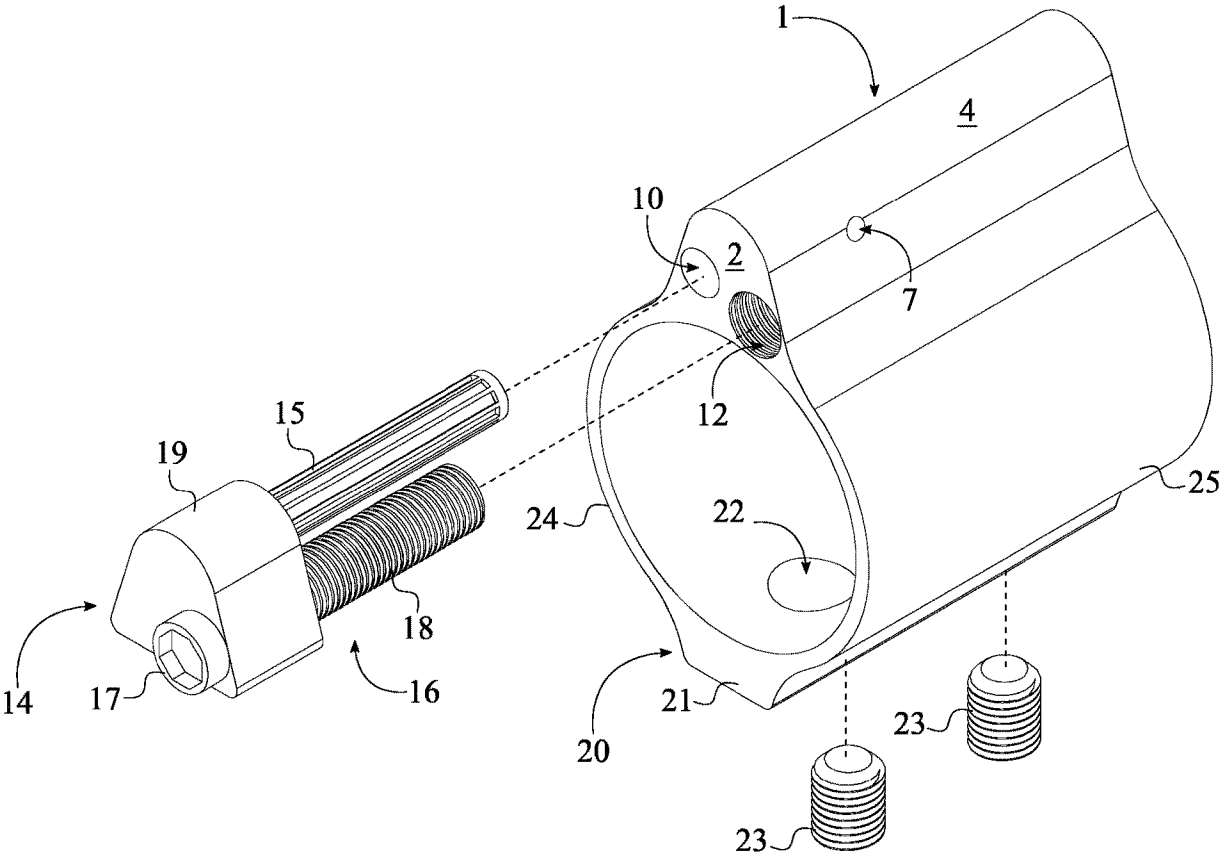
FIG. 3 is an exploded view of the present invention.

The present invention is a gas flow volume control apparatus for firearms that provides a low-profile and adjustable gas block 1. The present invention efficiently redirects the flow of high-pressure gas from inside the gun barrel of the firearm through the body of the present invention and into the gas tube of the firearm to drive the bolt carrier of the firearm and cycles the action, meaning the disposal of the spent case and the loading of a new cartridge so that the firearm is prepared to fire once again. The present invention also allows the volume for the flow of high-pressure gas to be controlled as the flow of high-pressure gas that is recycled through the gas-operated reloading mechanism of the firearm. The present invention comprises an adjustable gas block 1, an adjustment member 14, a securing member 20 as shown in FIG. 1-3. In reference to the general configuration of the present invention, the adjustable gas block 1 that harvest and redirect the flow of high-pressure gas is adjacently connected atop the securing member 20 that secures the present invention to the firearm. The adjustment member 14 is engaged with the adjustable gas block 1 thus allowing the user to efficiently control the amount of the flow of high-pressure gas that is harvested through the adjustable gas block 1. The present invention can be retrofitted or pre-manufactured with different firearms that utilize the gas-operated reloading mechanism.

Figure 5:
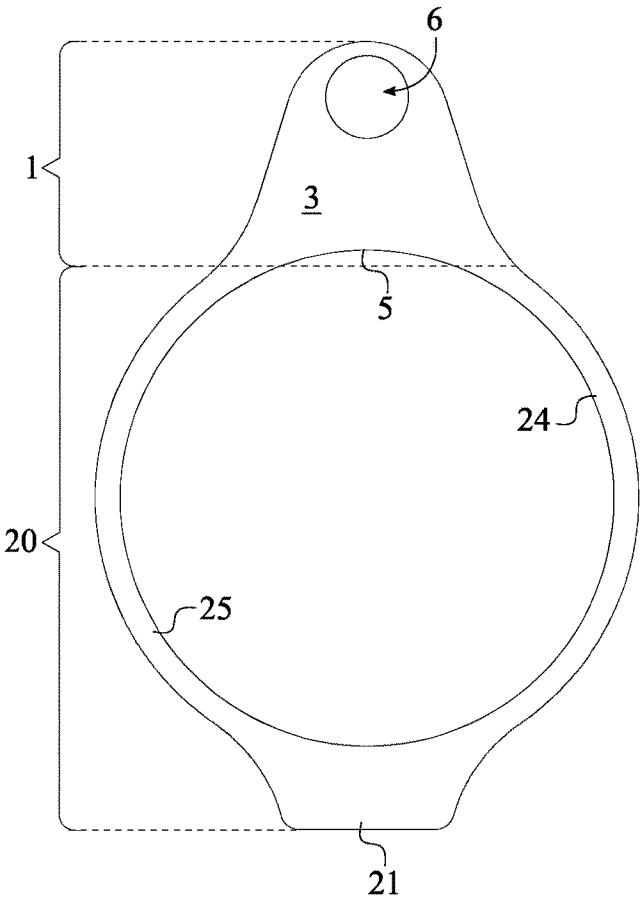
FIG. 5 is a rear view of the adjustable gas block of the present invention.
Figure 4:
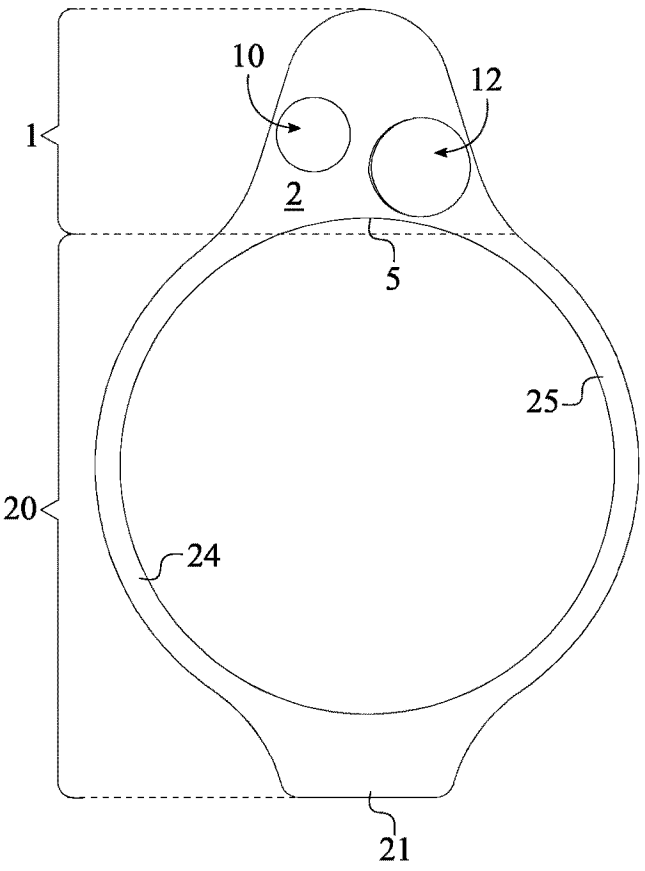
FIG. 4 is a front view of the adjustable gas block of the present invention.

The securing member 20, that secures the adjustable gas block 1 onto the gun barrel, is a generally cylindrical in shape and comprises a connector base 21, a first lateral wall 24, and a second lateral wall 25. In reference to FIG. 4-5, the connector base 21 is diametrically opposed of the adjustable gas block 1 while the first lateral wall 24 and the second lateral wall 25 are connected in between the connector base 21 and the adjustable gas block 1 opposite of each other. In other words, the connector base 21 and the adjustable gas block 1 are connected by the first lateral wall 24 from one side. Then, the connector base 21 and the adjustable gas block 1 are connected by the second lateral wall 25, wherein the second lateral wall 25 is positioned opposite of the first lateral wall 24. The connector base 21 secures the present invention onto the firearm while the first lateral wall 24 and the second lateral wall 25 function as the supporting members.

Figure 6:
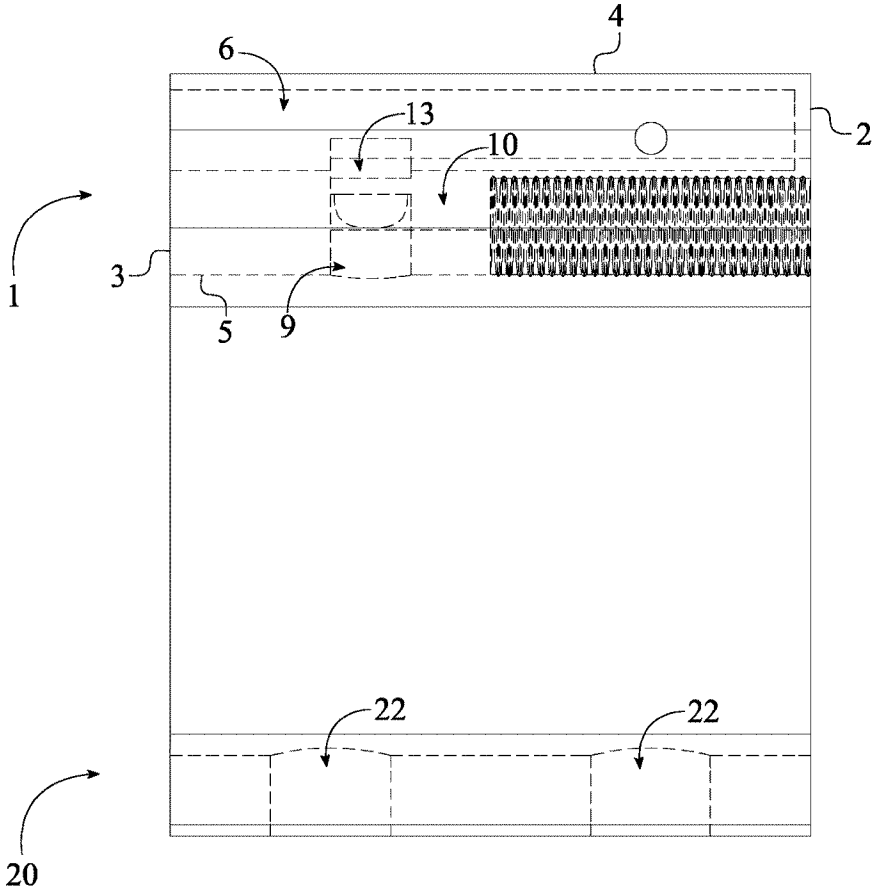
FIG. 6 is a side view of the adjustable gas block of the present invention, wherein the dash lines illustrate inner components.

The connector base 21 comprises at least one mounting hole 22 and at least one fastener screw 23. The at least one mounting hole 22 traverses through the connector base 21 as shown in FIG. 6, thereby allowing the at least one fastener screw 23 to be engaged within the at least one mounting hole 22. As a result, the present invention can be fixed at some point along the gun barrel. The at least one mounting hole 22 is oriented perpendicular to a central axis of the present invention so that the at least one fastener screw 23 is able to securely fix the adjustable gas block 1 with the gun barrel. Preferably, the at least one mounting hole 22 is a threaded opening and the at least one fastener screw 23 is a set screw so that the tightening of the set screw, through the threaded opening, can secures the present invention to the gun barrel. Optionally, the first lateral wall 24 and the second lateral wall 25 each comprises a cutout that is perimetrically located within the first lateral wall 24 and the second lateral wall 25. The cutout is intended to reduce the overall weight of the present invention, thereby minimizing the amount of weight added to the firearm when the present invention is installed. In an alternative embodiment, the securing member 20 comprises only the first lateral wall 24 and the second lateral wall 25, where the first lateral wall 24 and the second lateral wall 25 are secured together as a clamping mechanism. More specifically, the adjustable gas block 1 is securely mounted to the gun barrel through clamping pressure of the first lateral wall 24 and the second lateral wall 25.

The adjustable gas block 1 is in fluid communication with the gun barrel so that the flow of high-pressure gas, which is created behind a propelling bullet, can be harvested and redirected for the gas-operated reloading mechanism. In reference to FIG. 3-5, the adjustable gas block 1 comprises a front surface 2, a rear surface 3, an external surface 4, a barrel interface surface 5, a gas-tube channel 6, a gas-flow channel 9, a flow-adjustment channel 10, and a screw-receiving channel 12. The barrel interface surface 5 is positioned in between the first lateral wall 24 and the second lateral wall 25 and extends from the front surface 2 to the rear surface 3. In other words, the barrel interface is tangent to an inside surface of the first lateral wall 24 and the second lateral wall 25 thus forming a circular cross-section. The barrel interface surface 5 is formed to match with the shape of the gun barrel so that the adjustable gas block 1 can be hermetically connected with the gun barrel, optimizing the collection of the flow of high-pressure gas. Similar to the barrel interface surface 5, the external surface 4 extends from the front surface 2 to the rear surface 3 and delineate the outer shape of the adjustable gas block 1. In other words, the external surface 4 is tangent to an outside surface of the first lateral wall 24 and the second lateral wall 25 thus forming the profile of the adjustable gas block 1.

Figure 8:
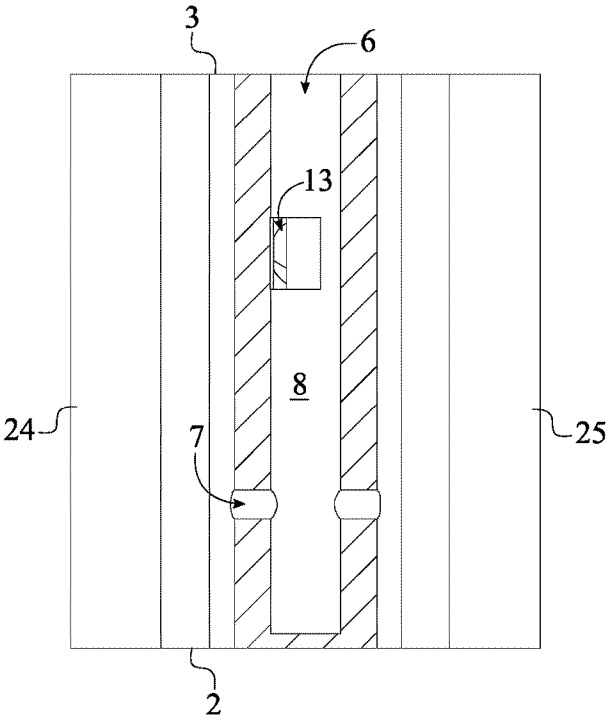
FIG. 8 is a cross section view of the adjustable gas block of the present invention taken along line A-A of FIG. 7, showing the passageway opening from the inner surface of the gas-tube channel.
Figure 7:
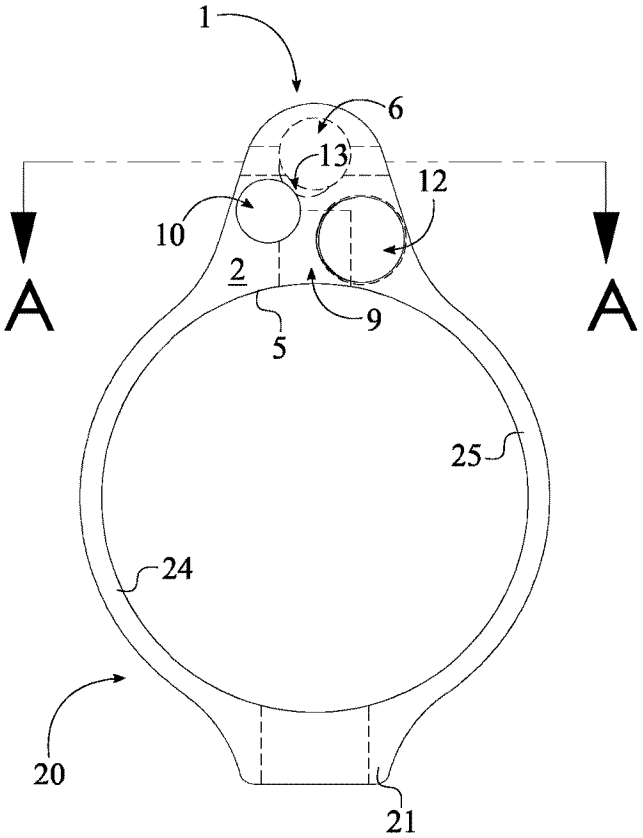
FIG. 7 is a front view of the adjustable gas block of the present invention, showing the plane upon which a cross sectional view is taken shown in FIG. 8.

The gas-tube channel 6 is designed to receive the gas tube so that the flow of high-pressure gas can be rerouted back into the firearm to assist with the gas-operated reloading mechanism. In reference to FIG. 7-10, the gas-tube channel 6 traverses into the adjustable gas block 1 from the rear surface 3 so that the gas tube can be directly place in between the present invention and the gas-operated reloading mechanism. More specifically, the gas-tube channel 6 is offset from the barrel interface surface 5 and oriented parallel with the barrel interface surface 5 so that the gas-flow channel 9, the flow-adjustment channel 10, and the screw-receiving channel 12 can be positioned in between the gas-tube channel 6 and the barrel interface surface 5. In reference to FIG. 8, the present invention further comprises a tube-connector recess 7 that traverses through adjustable gas block 1 from the external surface 4. More specifically, the tube-connector recess 7 is perpendicularly intersected with the gas-tube channel 6 as the tube-connector recess 7 is completely traversed through the adjustable gas block 1. The tube-connector recess 7 functions as a securing mechanism between the gas tube and the gas-tube channel 6 so that the gas tube and the gas-tube channel 6 do not separate during operation of the firearm. Furthermore, the tube-connector recess 7 is positioned adjacent to the front surface 2 so that the gas tube can be inserted more than halfway through the adjustable gas block 1 thus providing a secure placement.

Figure 10:
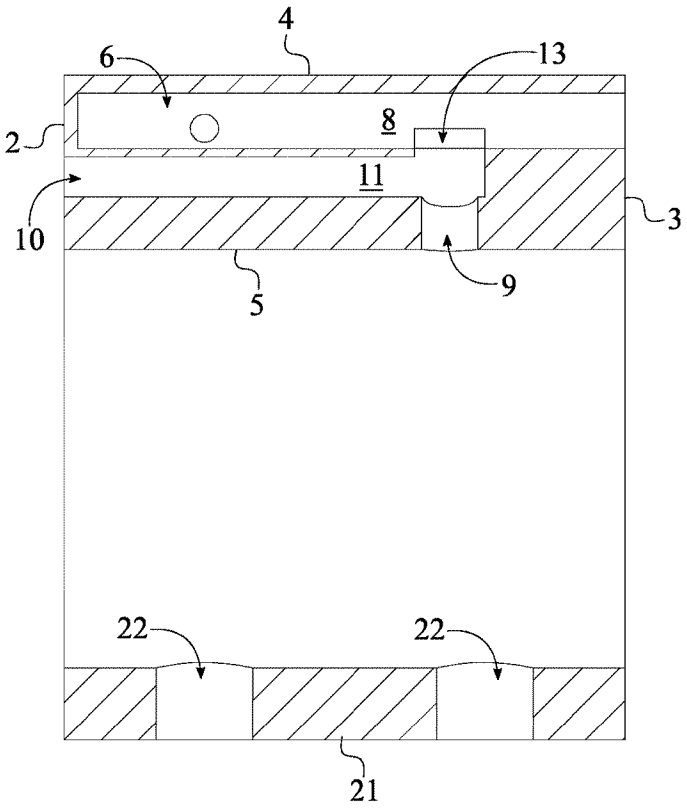
FIG. 10 is a cross section view of the adjustable gas block of the present invention taken along line A-A of FIG. 9, showing the passageway opening from the inner surface of the gas-tube channel and the inner surface of the flow-adjustment channel.
Figure 9:
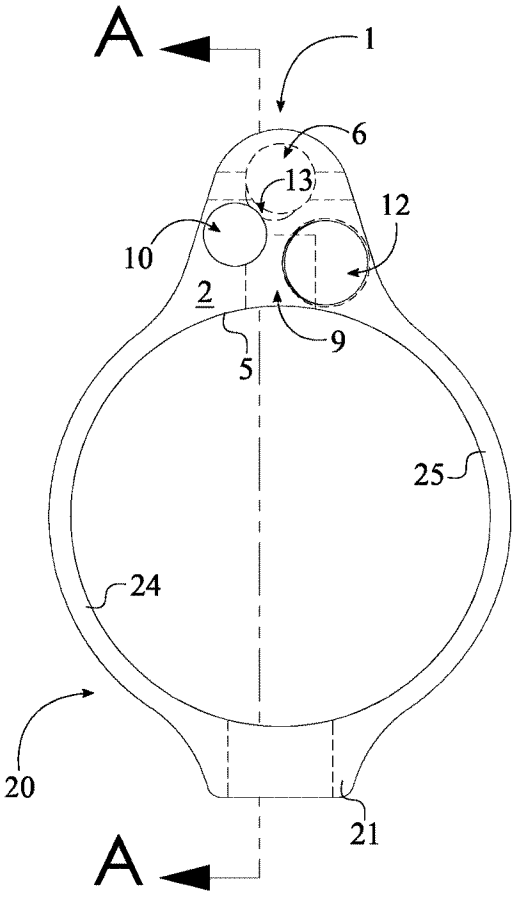
FIG. 9 is a front view of the adjustable gas block of the present invention, showing the plane upon which a cross sectional view is taken shown in FIG. 10.

The gas-flow channel 9 that harvests the flow of high-pressure gas from the gun barrel and reroutes the flow of high-pressure gas into the gas-tube channel 6 through the flow-adjustment channel 10. More specifically, the gas-flow channel 9 traverses into the adjustable gas block 1 from the barrel interface surface 5 as shown in FIG. 9-10. The gas-flow channel 9 is perpendicularly oriented with the gas-tube channel 6 in such a way that the gas-flow channel 9 is vertically positioned between the barrel interface surface 5 and the gas-tube channel 6.

The flow-adjustment channel 10 allows the adjustment member 14 to control amount of the flow of high-pressure gas discharged into the gas-tube channel 6. In reference to FIG. 10, the flow-adjustment channel 10 traverses into the adjustable gas block 1 from the front surface 2. Since the flow-adjustment channel 10 traverses into the adjustable gas block 1 from the front surface 2, a user is able to easily control the volume for the flow of high-pressure gas through the adjustment member 14. Additionally, the flow-adjustment channel 10 is positioned in between the barrel interface surface 5 and the gas-tube channel 6, wherein the flow-adjustment channel 10 is oriented parallel with the barrel interface surface 5 and the gas-tube channel 6.

In reference to FIG. 9-10, the gas-flow channel 9 is in fluid communication with the gas-tube channel 6 through the flow-adjustment channel 10. Resultantly, the flow of high-pressure gas from the gun barrel is first harvested through the gas-flow channel 9. Then, the harvested flow of high-pressure gas is rerouted into the gas-tube channel 6 through the flow-adjustment channel 10. The aforementioned indirect path for the flow of high-pressure gas impedes and slows down the flow of gas within the present invention so that the structural integrity of the adjustable gas block 1 can be improved. In order to attain the indirect path, the adjustable gas block 1 further comprises a passageway 13 as shown in FIG. 6 and FIG. 10. More specifically, the gas-flow channel 9 partially traverses into an inner surface 11 of the flow-adjustment channel 10 from the barrel interface surface 5 thus resulting the flow of high-pressure gas to turns about the end of the gas-flow channel 9 and flows into the flow-adjustment channel 10. The flow of high-pressure gas within the flow-adjustment channel 10 then flows into the gas-tube channel 6 as the passageway 13 traverses from the inner surface 11 of the flow-adjustment channel 10 to an inner surface 8 of the gas-tube channel 6.

In reference to FIG. 3, the screw-receiving channel 12 traverses into the adjustable gas block 1 from the front surface 2 so that the adjustment member 14 can be threadedly engaged with the screw-receiving channel 12. More specifically, the screw-receiving channel 12 is positioned in between the barrel interface surface 5 and the gas-tube channel 6 in such a way that the screw-receiving channel 12 is oriented parallel with the barrel interface surface 5 and the gas-tube channel 6.

Figure 11:
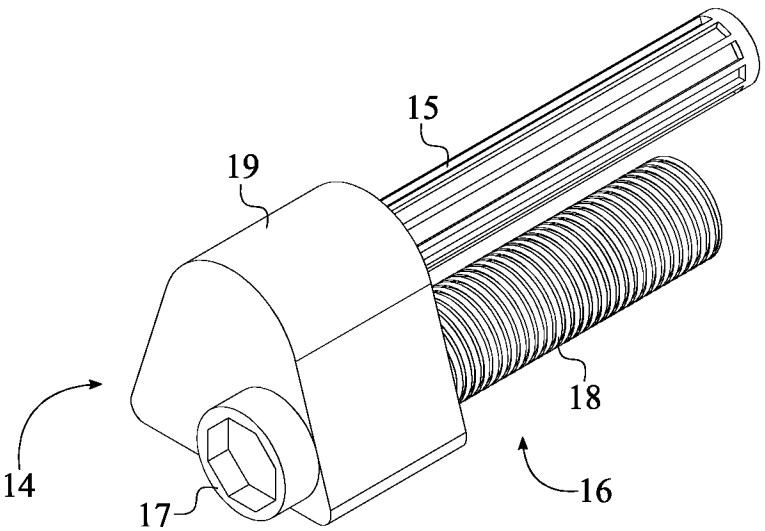
FIG. 11 is a perspective view of the adjustment member of the present invention.

The adjustment member 14, which control the volume for the flow of high-pressure gas within the flow-adjustment channel 10 comprises an adjustment pin 15, an adjustment screw 16, and a base 19 as shown in FIG. 11. The adjustment pin 15 that aligned with the flow-adjustment channel 10 is terminally connected to the base 19. The adjustment screw 16 that threadedly engaged with the screw-receiving channel 12 is rotatably engaged through the base 19. More specifically, a screw head 17 of the adjustment screw 16 is positioned opposite to the adjustment pin 15, and a threaded screw body 18 of the adjustment screw 16 is positioned adjacent to the adjustment pin 15 and oriented parallel to the adjustment pin 15. In other words, the screw head 17 and the threaded screw body 18 are positioned opposite of each other about the base 19 in such a way that the screw head 17 is concentrically positioned with the threaded screw body 18. When the adjustment member 14 is threadedly engaged with the adjustable gas block 1, the base 19 is adjacently positioned to the front surface 2 axially aligning the adjustment pin 15 and the adjustment screw 16. In reference to FIG. 3, the adjustment pin 15 traverses into the flow-adjustment channel 10 as the threaded screw body 18 is threadedly engaged with the screw-receiving channel 12. As a result, rotation of the screw head 17 allows the adjustment screw 16 to be manipulated by external forces while the threaded screw body 18 simultaneously rotate with the screw head 17. Furthermore, the rotational engagement between the adjustment screw 16 and the base 19 may comprises a detent mechanism to arrest precise rotation and to internally divide a single rotation into the discrete increments or decrements. The adjustment screw 16 is preferably manipulated by means of a hex key, which engages with the screw head 17 thus allowing a user to easily turn the adjustment screw 16. The hex key provides an advantage of increased reach, allowing a user to turn the adjustment screw 16 even if it partially obstructed or located in a confined space, wherein fingers and larger tools may be unable to operate. However, the adjustment screw 16 manipulation is not limited to hex key and can utilize other types of manipulation, such as a thumb screw.

The assembly and operation of the present invention requires the adjustment screw 16 to be engaged with the flow-adjustment channel 10. The adjustment screw 16 is driven into and out of the flow-adjustment channel 10 in very small increments in order to control the flow of high-pressure gas redirected through the adjustable gas block 1. In the preferred embodiment of the present invention, the adjustment screw 16 is engaged within the flow-adjustment channel 10. This engagement is accomplished by providing external threading on the adjustment screw 16 with matching internal threading on the flow-adjustment channel 10. This type of engagement allows the adjustment screw 16 to be driven into or out of the flow-adjustment channel 10 so that the adjustment pin 15 can move in between a fully opened configuration, a partially opened configuration, and a closed configuration of the gas-flow channel 9. For example, when the adjustment pin 15 is positioned away from the gas-flow channel 9 and the passageway 13, the present invention is considered to be in the fully opened configuration as the passageway 13 is completely opened in between the gas-tube channel 6 and the flow-adjustment channel 10. As a result, a full complement for the flow of high-pressure gas is able to discharge into the gas-tube channel 6 through the passageway 13. When the adjustment pin 15 partially extends from the gas-flow channel 9 and the passageway 13, the present invention is considered to be in the partially opened configuration as the passageway 13 is partially opened in between the gas-tube channel 6 and the flow-adjustment channel 10. As a result, a limited amount of the flow of high-pressure gas is able to discharge into the gas-tube channel 6 through the passageway 13. When the adjustment pin 15 fully extends into the gas-flow channel 9 and the passageway 13, the present invention is considered to be in the closed configuration as the passageway 13 is completely closed in between the gas-tube channel 6 and the flow-adjustment channel 10. As a result, the flow of high-pressure gas is not able to discharge into the gas-tube channel 6 through the passageway 13.

Although the invention has been explained in relation to its preferred embodiment, it is to be understood that many other possible modifications and variations can be made without departing from the spirit and scope of the invention as hereinafter claimed.

What is claimed is:

1. A gas flow volume control apparatus for firearms comprises:

an adjustable gas block;

an adjustment member;

a securing member;

the adjustable gas block comprises a front surface, a rear surface, an external surface, a barrel interface surface, a gas-flow channel, a gas-tube channel, a flow-adjustment channel, and a screw-receiving channel;

the adjustable gas block being adjacently connected atop the securing member;

the barrel interface surface and the external surface being extended from the front surface to the rear surface;

the gas-flow channel traversing in the adjustable gas block from the barrel interface surface;

the gas-tube channel traversing into the adjustable gas block from the rear surface;

the flow-adjustment channel traversing into the adjustable gas block from the front surface;

the screw-receiving channel traversing into the adjustable gas block from the front surface;

the gas-flow channel being in fluid communication with the gas-tube channel through the flow-adjustment channel; and the adjustment member being threadedly engaged with the screw-receiving channel.

2. The gas flow volume control apparatus for firearms as claimed in claim 1 comprises:

the securing member comprises a connector base, a first lateral wall, and a second lateral wall;

the connector base being diametrically opposed of the adjustable gas block;

the first lateral wall being connected in between the connector base and adjustable gas block;

the second lateral wall being connected in between the connector base and adjustable gas block, opposite of the first lateral wall; and the barrel interface surface being positioned in between the first lateral wall and the second lateral wall.

3. The gas flow volume control apparatus for firearms as claimed in claim 2 comprises:

the connector base comprises a body, at least one mounting hole and at least one fastener screw;

the at least one mounting hole traversing through the body; and the at least one fastener screw being engaged within the at least one mounting hole.

4. The gas flow volume control apparatus for firearms as claimed in claim 1, wherein the gas-flow channel being perpendicularly oriented with the gas-tube channel.

5. The gas flow volume control apparatus for firearms as claimed in claim 1 comprises:

a tube-connector recess;

the gas-tube channel being offset from the barrel interface surface;

the gas-tube channel being oriented parallel with the barrel interface surface;

the tube-connector recess traversing through the adjustable gas block from the external surface; and the tube-connector recess being perpendicularly intersected with the gas-tube channel.

6. The gas flow volume control apparatus for firearms as claimed in claim 5, wherein the tube-connector recess being positioned adjacent to the front surface.

7. The gas flow volume control apparatus for firearms as claimed in claim 1 comprises:

the flow-adjustment channel being positioned in between the barrel interface surface and the gas-tube channel; and the flow-adjustment channel being oriented parallel with the barrel interface surface and the gas-tube channel.

8. The gas flow volume control apparatus for firearms as claimed in claim 1 comprises:

the screw-receiving channel being positioned in between the barrel interface surface and the gas-tube channel; and the screw-receiving channel being oriented parallel with the barrel interface surface and the gas-tube channel.

9. The gas flow volume control apparatus for firearms as claimed in claim 1 comprises:

the adjustable gas block further comprises a passageway;

the gas-flow channel partially traversing into an inner surface of the flow-adjustment channel from the barrel interface surface; and the passageway traversing from the inner surface of the flow-adjustment channel to an inner surface of the gas-tube channel.

10. The gas flow volume control apparatus for firearms as claimed in claim 1 comprises:

the adjustment member comprises an adjustment pin, an adjustment screw, and a base;

the adjustment pin being terminally connected to the base;

the adjustment screw being rotatably engaged through the base;

a screw head of the adjustment screw being positioned opposite to the adjustment pin;

a threaded screw body of the adjustment screw being positioned adjacent to the adjustment pin;

the screw head being concentrically positioned with the threaded screw body; and the threaded screw body and the adjustment pin being oriented parallel with each other.

11. The gas flow volume control apparatus for firearms as claimed in claim 10 comprises:

the base being adjacently positioned to the front surface;

the adjustment pin traversing into the flow-adjustment channel; and the threaded screw body being threadedly engaged with the screw-receiving channel.

12. A gas flow volume control apparatus for firearms comprises:

an adjustable gas block;

an adjustment member;

a securing member;

the adjustable gas block comprises a front surface, a rear surface, an external surface, a barrel interface surface, a gas-flow channel, a gas-tube channel, a flow-adjustment channel, and a screw-receiving channel;

the adjustment member comprises an adjustment pin, an adjustment screw, and a base;

the adjustable gas block being adjacently connected atop the securing member;

the barrel interface surface and the external surface being extended from the front surface to the rear surface;

the gas-flow channel traversing in the adjustable gas block from the barrel interface surface;

the gas-tube channel traversing into the adjustable gas block from the rear surface;

the flow-adjustment channel traversing into the adjustable gas block from the front surface;

the screw-receiving channel traversing into the adjustable gas block from the front surface;

the gas-flow channel being in fluid communication with the gas-tube channel through the flow-adjustment channel;

the adjustment pin being terminally connected to the base;

the adjustment screw being rotatably engaged through the base;

a screw head of the adjustment screw being positioned opposite to the adjustment pin;

a threaded screw body of the adjustment screw being positioned adjacent to the adjustment pin;

the screw head being concentrically positioned with the threaded screw body;

the threaded screw body and the adjustment pin being oriented parallel with each other;

the base being adjacently positioned to the front surface;

the adjustment pin traversing into the flow-adjustment channel; and the threaded screw body being threadedly engaged with the screw-receiving channel.

13. The gas flow volume control apparatus for firearms as claimed in claim 12 comprises:

the securing member comprises a connector base, a first lateral wall, and a second lateral wall;

the connector base being diametrically opposed of the adjustable gas block;

the first lateral wall being connected in between the connector base and adjustable gas block;

the second lateral wall being connected in between the connector base and adjustable gas block, opposite of the first lateral wall; and the barrel interface surface being positioned in between the first lateral wall and the second lateral wall.

14. The gas flow volume control apparatus for firearms as claimed in claim 13 comprises:

the connector base comprises a body, at least one mounting hole and at least one fastener screw;

the at least one mounting hole traversing through the body; and the at least one fastener screw being engaged within the at least one mounting hole.

15. The gas flow volume control apparatus for firearms as claimed in claim 12, wherein the gas-flow channel being perpendicularly oriented with the gas-tube channel.

16. The gas flow volume control apparatus for firearms as claimed in claim 12 comprises:

a tube-connector recess;

the gas-tube channel being offset from the barrel interface surface;

the gas-tube channel being oriented parallel with the barrel interface surface;

the tube-connector recess traversing through the adjustable gas block from the external surface; and the tube-connector recess being perpendicularly intersected with the gas-tube channel.

17. The gas flow volume control apparatus for firearms as claimed in claim 16, wherein the tube-connector recess being positioned adjacent to the front surface.

18. The gas flow volume control apparatus for firearms as claimed in claim 12 comprises:

the flow-adjustment channel being positioned in between the barrel interface surface and the gas-tube channel; and the flow-adjustment channel being oriented parallel with the barrel interface surface and the gas-tube channel.

19. The gas flow volume control apparatus for firearms as claimed in claim 12 comprises:

the screw-receiving channel being positioned in between the barrel interface surface and the gas-tube channel; and the screw-receiving channel being oriented parallel with the barrel interface surface and the gas-tube channel.

20. The gas flow volume control apparatus for firearms as claimed in claim 12 comprises:

the adjustable gas block further comprises a passageway;

the gas-flow channel partially traversing into an inner surface of the flow-adjustment channel from the barrel interface surface; and the passageway traversing from the inner surface of the flow-adjustment channel to an inner surface of the gas-tube channel.

* * * * *